US007481260B2

(12) United States Patent
Hagen

(10) Patent No.: US 7,481,260 B2
(45) Date of Patent: Jan. 27, 2009

(54) TIGHTENING DEVICE FOR BLINDS

(75) Inventor: Helge Hagen, Frederikshavn (DK)

(73) Assignee: Hagen Holding APS, Frederikshavn (DK)

( * ) Notice: Subject to any disclaimer, the term of this patent is extended or adjusted under 35 U.S.C. 154(b) by 231 days.

(21) Appl. No.: 10/585,527

(22) PCT Filed: Jan. 7, 2005

(86) PCT No.: PCT/NO2005/000008

§ 371 (c)(1),
(2), (4) Date: Oct. 10, 2006

(87) PCT Pub. No.: WO2005/066445

PCT Pub. Date: Jul. 21, 2005

(65) Prior Publication Data

US 2008/0029230 A1 Feb. 7, 2008

(30) Foreign Application Priority Data

Jan. 9, 2004 (NO) ..... 20040105

(51) Int. Cl.
*A47G 5/02* (2006.01)

(52) U.S. Cl. ..... 160/265; 160/310

(58) Field of Classification Search ..... 160/310, 160/274, 265, 266, 267.1
See application file for complete search history.

(56) References Cited

U.S. PATENT DOCUMENTS

| | | | | |
|---|---|---|---|---|
| 3,280,893 | A * | 10/1966 | Webb et al. | 160/281 |
| 4,762,160 | A * | 8/1988 | Bechtold et al. | 160/98 |
| 4,815,515 | A * | 3/1989 | Lee | 160/23.1 |
| 5,655,591 | A * | 8/1997 | Knutson | 160/265 |
| 6,530,414 | B2 * | 3/2003 | Mayr et al. | 160/98 |
| 7,059,376 | B2 * | 6/2006 | Tussinger | 160/98 |
| 2004/0040675 | A1 * | 3/2004 | Siefert | 160/265 |
| 2005/0051283 | A1 * | 3/2005 | Chatellard et al. | 160/265 |
| 2005/0161175 | A1 * | 7/2005 | Tussinger | 160/265 |

FOREIGN PATENT DOCUMENTS

| | | |
|---|---|---|
| DE | 196 10 268 | 9/1997 |
| DK | 96 00317 | 1/1998 |
| EP | 0 109 382 | 5/1984 |
| GB | 2 166 480 | 5/1986 |

OTHER PUBLICATIONS

International Search Report dated May 12, 2005.

* cited by examiner

*Primary Examiner*—Katherine W Mitchell
*Assistant Examiner*—Jaime F Cardenas-Garcia
(74) *Attorney, Agent, or Firm*—Nields & Lemack

(57) ABSTRACT

A device for automatic tightening of blinds is disclosed, where the manipulation of the blinds is controlled through the aid of belts running between the outer lists of a window.

7 Claims, 3 Drawing Sheets

1
16
16
4b
4aa
4a
16
5
16

TIGHTENING DEVICE FOR BLINDS

The present invention concerns a tightening device for roller blinds, and especially roller blinds being driven by a motor.

When activating conventional roller blinds it is common that these do not have any tightening devices, something leaving the lower roller blind edge often hanging loosely or the tightening is obtained passively by the roller blind being equipped with a lower list ensuring the tightening based on its weight.

In motorized rolling blinds, e.g. rolling binds located between isolation glass panes, this is possible, but if the motor does not stop the descent of the roller blind there may arise unsightly folds in the rolling curtain and is additionally such folds may let light pass through at the edges of the roller curtain.

E.g. from U.S. Pat. No. 6,530,414 there is known a motorized roller curtain being pulled from bottom to top and being regulated by the aid of a motor. However, there is not disclosed anything in this patent concerning the tightening of the roller curtain.

Thus there exists a need for a device that may tighten the roller blind automatically over the total length of the moving distance of the roller blind.

According to the present invention there has been obtained such a tightening device for a horizontally or a vertically running roller blind wherein the roller blind is wound out or in from a drum, and wherein the out- or in-winding from the drum is guided through the aid of belts or chains running over both ends of the drum and running from the drum to a rotational bearing for the belts or the chains, the tightening device comprising an axle located in the free edge of the roller blind, wherein the axle runs between rollers being connected to the belts, and which, when moving the belts, are rotated and thereby rotate the axle, the axle comprising a pre-loaded spring which, when rotating the axle, applies a force on the axle pressing it in a direction away from the drum for the roller blind.

Such a tightening device may particularly be used in a roller blind system that may be mounted inside an insulation glass. In such an insulation glass there is included a frame comprising four profiles or frame parts, one upper and one lower frame part and two side frame parts.

The frame parts include an on/off-winding mechanism for a roller blind. The frame parts may additionally be designed they together form a profile frame for an insulation glass. The roller blind per se is wound onto an axle/pipe in the upper horizontal profile part. The "free" end of the roller blind is secured to a bottom list which through a special mechanism is connected to two cog belts in the side profiles. This special mechanism has the effect that the bottom list with the free end of the roller blind is pushed away from the axle/pipe in the upper profile part, and the roller blind will on account of this be tightened to hang straight.

The winding mechanism includes a pipe being located inside the upper frame part. In each end of the pipe there is mounted a cog belt disc. Over each of the two cog belt discs there is located a cog belt that passes downwards along the two side frame parts to a cog belt wheel in the other end of the side frame part.

Onto the pipe there is wound a foil or a curtain. The free end of the foil or curtain there is secured a bottom list which in principle hangs freely inside the frame.

Internally inside the bottom list there is mounted a penetrating rotational axle. This axle is spring-loaded (torsion spring). On the axle there are mounted two cog wheels cooperating with two cog belts running along the two perpendicular profiles in the profile frame. The two cog belts move substantially synchronically with the on- or off-winding of the foil/blind on the pipe. This relative movement passes the bottom list along up or down inside the frame. The spring-loaded axle in the bottom list ensures that the bottom list, through the two attached cog belt wheels, attempts to move away from the pipe so that the foil or blind is tightened to hang straight between the pipe and the bottom list irrespective of where in the frame the bottom list is located.

The invention will be illustrated with reference to the enclosed figures that show an embodiment of the tightening device according to the invention mounted inside a profile frame, and wherein FIG. 1 shows the frame wherein the whole roller blind mechanism is mounted. 1 is the upper horizontal profile. 4*a* and 4*b* are the two perpendicular profiles, and 5 is the lower horizontal profile. 16 are corner pieces assembling the corners in the profile frame.

Figure 1:
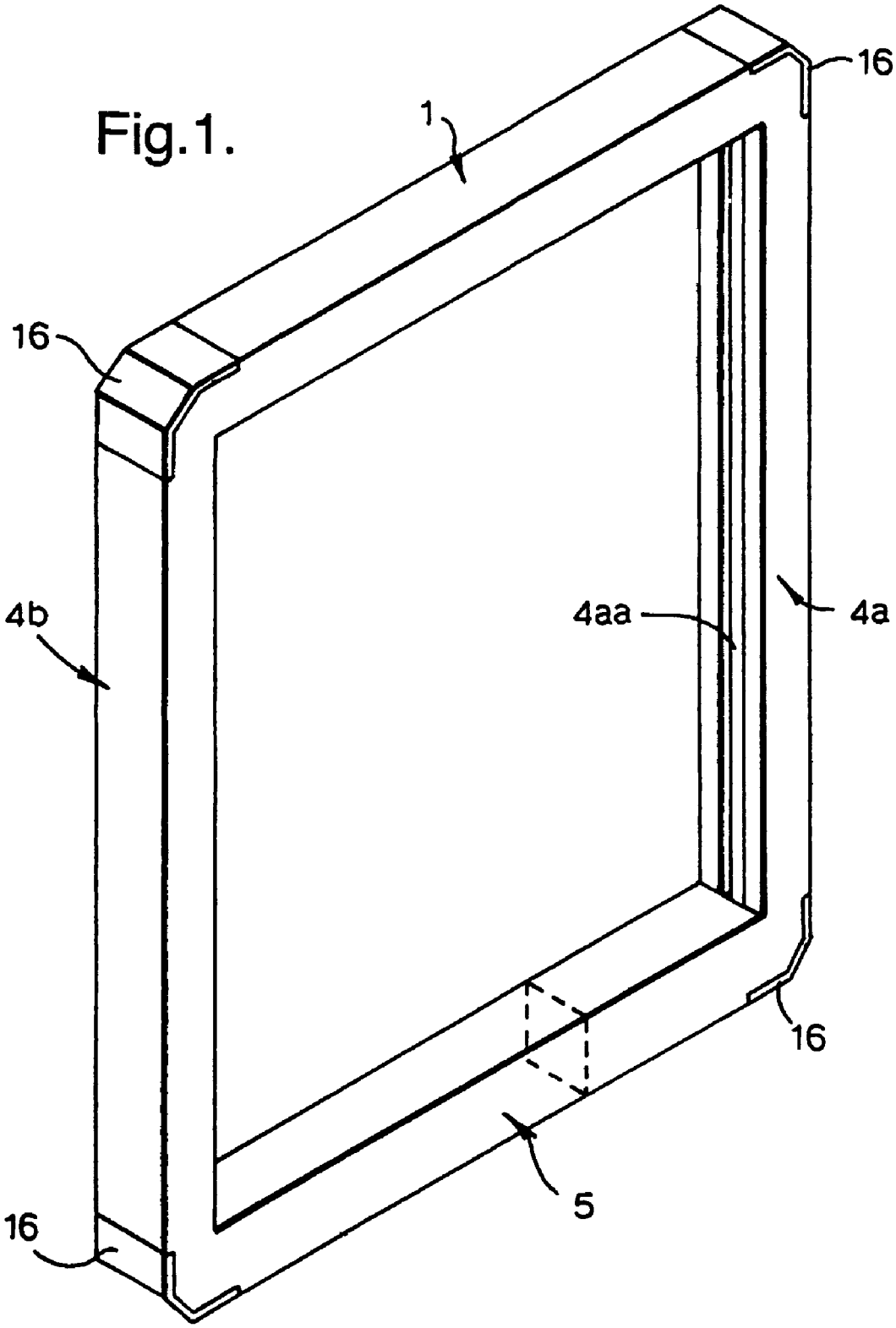
Figure 2:
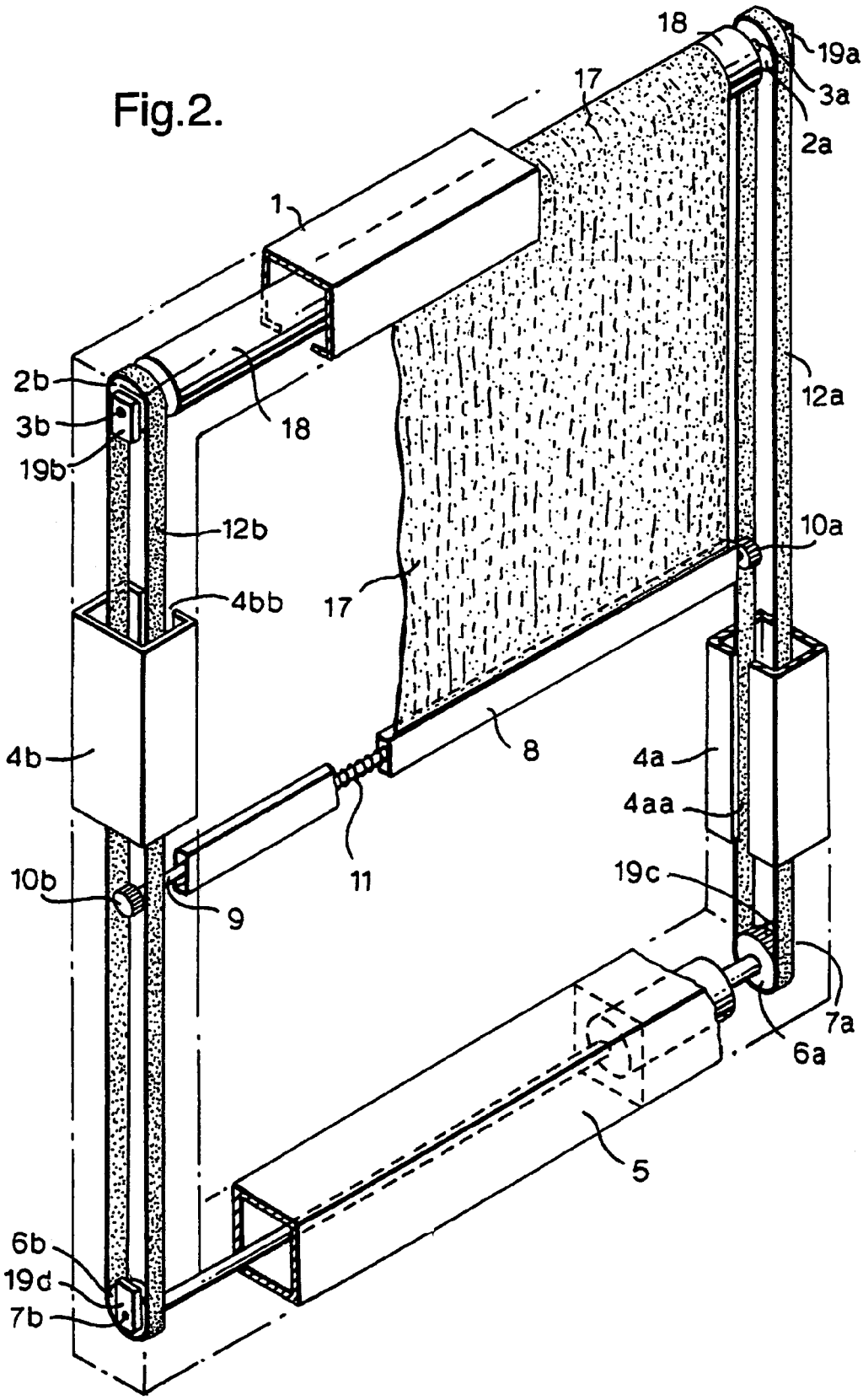
FIG. 2 shows the same frame parts 1, 4*a*, 4*b* and 5 as in FIG. 1, but sectioned so that the roller blind mechanism also is displayed.
Figure 3:
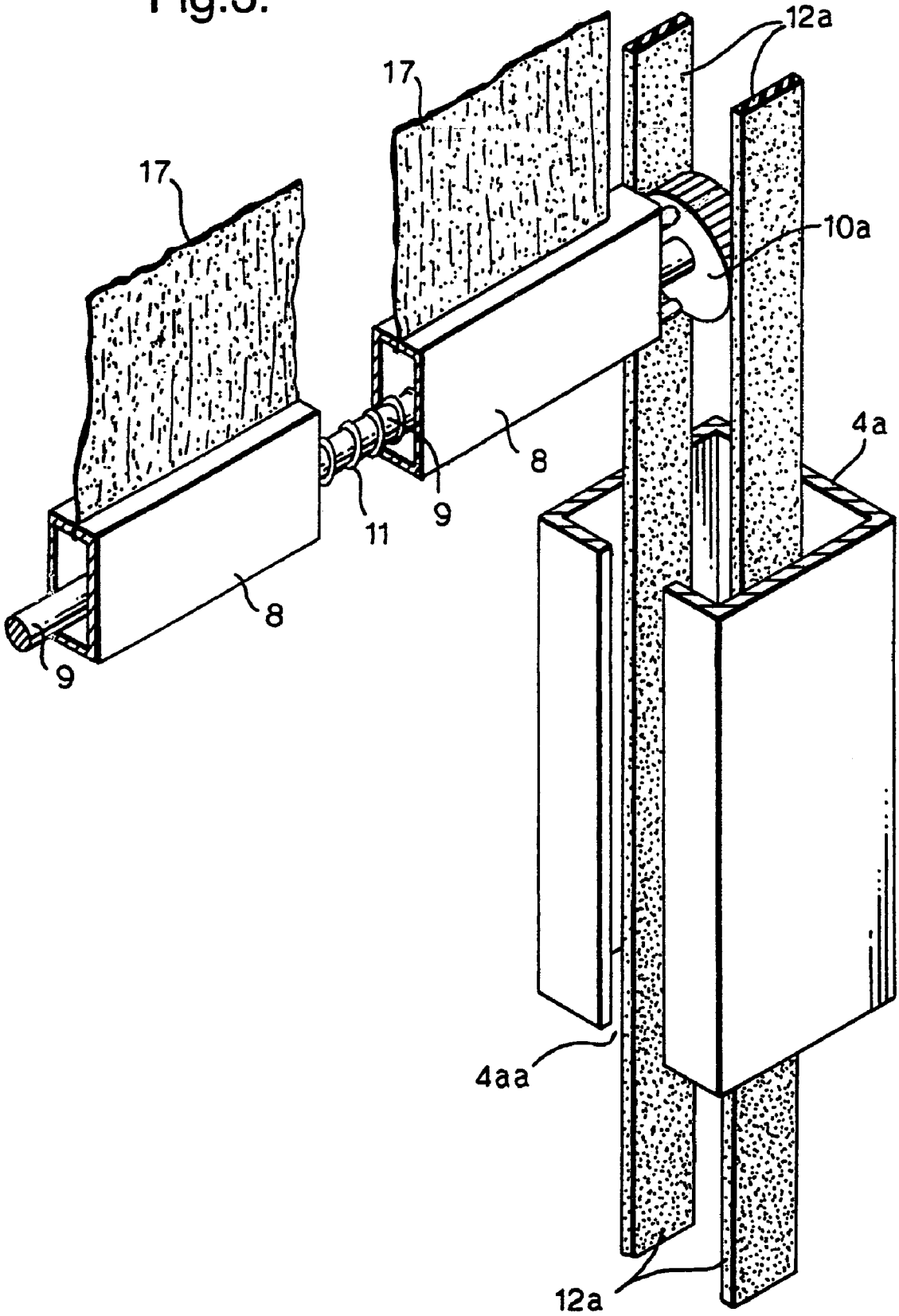
FIG. 3 shows a detailed figure for the lower bottom list and the axle in the roller blind.

The roller blind 17 is wound up onto an axle/pipe 18. In each end of the pipe 18 there is secured a cog belt wheel 2*a*, 2*b*. The connection between the cog belt wheels 2*a*, 2*b* and the pipe 18 is in the displayed embodiment braced with two pins 3*a*, 3*b*. The cog belt wheels 2*a*, 2*b* lie in bearings inside two bearing supports 19*a*, 19*b*. These are secured to the two perpendicular parts of the frame 4*a*, 4*b*.

Correspondingly, there are two cog belt wheels 6*a*, 6*b*, two bearing supports 19*c*, 19*d* at the other end of the two perpendicular profile parts 4*a*, 4*b*.

The cog belt 12*b* runs over the cog belt wheels 2*b*, 6*b* inside the perpendicular profile 4*b*. Similarly the cog belt 12*a* runs over the cog belt wheels 2*a*, 6*a* inside the perpendicular profile 4*a*. The cog belts may be endless or non-endless. In a special embodiment the cog belts are non-endless.

A motor 15 mounted inside the lower horizontal profile 5 and is connected to the cog belt wheel 6*a*. When the motor turns in one or the other direction, the wheel 18 will thereby rotate and the roller blind is wound onto or off the pipe 18.

The free end of the roller blind is secured to the bottom list 8. Inside the bottom list 8 there is a penetrating axle 9. A torsion spring 11 is running between the axle 9 and the bottom list 8. In each end of the axle 9 there is secured a cog belt wheel 10*a*, 10*b*. These two cog belt wheels 10*a*, 10*b* cooperate with two cog belts 12*a*, 12*b* running along the side frame profiles 4*a*, 4*b*.

The spring 11 is preloaded so that it will rotate the axle 9 in a direction so that the bottom list 8 is pressed down and away from the pipe 18. The roller blind 17 will thus be tightened. The cog belt wheels 10*a*, 10*b* are mounted on some free holders sliding inside a groove 4*aa*, 4*bb* in the perpendicular profiles 4*a*, 4*b*.

When the pipe 18 is rotated and the roller blind is wound off or onto the pipe 18, the cog belts 12*a*, 12*b* will also mode up or down inside the profiles 4*a*, 4*b*. The cog belts will draw along the bottom list 8. The torsion spring 11 will transfer a rotating force to the axle 9 which in its turn will rotate the cog belt wheels 10*a*, 10*b*. This movement will press the bottom list down and tighten the roller blind.

The tightening device according to the invention may be used in a roller blind system being collected in a frame that may function as a distance frame for an insulation glass system.

The bottom list is secured in the free end of the roller blind material and has an integral axle with a spring mechanism wherein any or the one end of the axle has mounted a cog belt wheel which cooperate with the one or both the cog belts running inside the two side profiles.

The curtain material is wound up on a pipe that is not carried on a solid or rotating axle, but has a bearing at each end.

Cog belts in the side profiles are moved synchronically with the rotation of the pipe onto which the roller blind is wound.

The invention may be used in a profile frame wherein each part is designed so that it may include a motor while there simultaneously being room for an amount of a molecular sieve (drying substance, desiccating substance) that is required for an insulation glass.

The invention claimed is:

1. Tightening device for a horizontally or vertically running roller blind having a free end wherein the roller blind is wound out or onto a roller, and wherein the winding in or out of the roller blind from the roller is guided by the aid of belts running from both ends of the roller to a rotational bearing for the belts (12*a*, 12*b*), wherein the tightening device comprises an axle located at said free end of the roller blind, wherein the axle runs between rollers being connection to the belts and which through the movement of the belts are rotated and thereby rotates the axle, the axle comprising a pre-loaded spring which through the rotation of the axle exercises a force on the axle pressing the axle in a direction away from the roller for the roller blind

2. Tightening device according to claim 1, wherein the axle is connected to a list at said free end of the roller blind.

3. Tightening device according to claim 1 wherein said belts are cog belts cooperating with cog wheels being located at the ends of the roller for the roller blind.

4. Tightening device according to claim 3, wherein said cog belts run in profiles with grooves for the roller blind.

5. Tightening device according to claim 3, wherein said cog belts are not endless.

6. Tightening device according to claim 4, wherein said profiles comprises opposite parts of a profile frame.

7. Tightening device according to claim 1, wherein the guidance of the roller for the roller blind is performed through the aid of a motor.

* * * * *